United States Patent [19]

Culgan et al.

[11] Patent Number: 4,646,667

[45] Date of Patent: Mar. 3, 1987

[54] PROCESS FOR MAKING AN ELASTOMERIC YARN SUPPLY PACKAGE

[75] Inventors: John M. Culgan, Chadds Ford, Pa.; Leander A. Sherbeck, Waynesboro, Va.

[73] Assignee: E. I. Du Pont de Nemours and Company, Wilmington, Del.

[21] Appl. No.: 878,609

[22] Filed: Jun. 26, 1986

Related U.S. Application Data

[62] Division of Ser. No. 288,026, Jul. 29, 1981.

[51] Int. Cl.[4] ..... D05B 97/00; D04B 19/00

[52] U.S. Cl. ..... 112/262.1; 28/218

[58] Field of Search ..... 112/262.1, 262.2, 269.1, 112/412, 440, 441, 438; 428/394, 300, 364, 373; 57/210, 243, 244, 908; 66/195; 28/218; 139/425

[56] References Cited

U.S. PATENT DOCUMENTS

| | | | |
|---|---|---|---|
| 255,993 | 4/1882 | Hosmer et al. | 112/438 X |
| 881,903 | 3/1900 | Cornely | 112/440 X |
| 1,554,532 | 9/1925 | Stead | 28/218 X |
| 2,248,907 | 7/1941 | Lutz | 112/438 X |
| 2,961,738 | 11/1960 | Thomas | 112/412 X |
| 3,536,019 | 10/1970 | Honda et al. | 28/218 X |
| 3,793,816 | 2/1974 | Kodama | 28/218 X |
| 3,827,261 | 8/1974 | Rupprecht | 66/195 |
| 3,903,714 | 9/1975 | Horeni et al. | 112/412 X |

OTHER PUBLICATIONS

"Instructions for Setting Up and Operating Class 70 Merrow Machines", The Merrow Machine Company, Hartford, Conn., Copyright 1973.

*Primary Examiner*—H. Hampton Hunter

[57] ABSTRACT

An elastomeric strand supply package is provided in the form of a bundle of elastomeric strands held together by a series of connected chain stitches which extend along the length of the bundle. The chain stitches are unravelled to free the individual strands, as the strands are being fed to a textile machine.

4 Claims, 2 Drawing Figures

PROCESS FOR MAKING AN ELASTOMERIC YARN SUPPLY PACKAGE

This is a division of application Ser. No. 288,026, filed July 29, 1981.

BACKGROUND OF THE INVENTION

1. Field of the Invention

This invention relates to a textile supply package for feeding a plurality of elastomeric strands to a machine for making fabrics, covered yarns or the like. More particularly, the invention concerns such a package which comprises a bundle of elastomeric strands around which is sewn a connected series of chain stitches.

2. Description of the Prior Art

In most weaving, knitting or yarn-covering operations, large numbers of strands are fed simultaneously to a textile machine. Usually, the strands are supplied from a creel frame on which numerous yarn packages are mounted. Each package contains one wound-up strand. Another conventional method involves supplying the fabric-making machine with a multiplicity of strands from one large beam. These known strand supply devices usually are very large and require much floor space. To reduce these space requirements, suggestions have been made that the required number of strands be supplied in the form of a knitted package from which the strands can be unravelled and fed to the fabric-making machine. Rupprecht, U.S. Pat. No. 3,827,261 discloses one such knit package made of spandex strands. However, the speed with which packages of spandex yarns can be fabricated is limited by the slow speed of the knitting machines on which the packages must be made. The slow speeds of fabrication add to the cost of the unravellable package, as well as to the cost of the fabrics made therefrom.

It is also known to supply strands of slitted rubber in the form of a package wherein the strands have been readhered to each other and then dusted with talc. However, this method is not generally applicable to other elastomeric yarns.

SUMMARY OF THE INVENTION

The present invention provides an elastomeric yarn supply package which can be made simply, economically and at high speeds and which is especially useful with spandex filaments. The package comprises a bundle of substantially parallel elastomeric strands which are held together by a succession of connected chain stitches which extend along the length of the bundle. Preferably, the chain stitches are formed with one nonelastomeric strand. The average spacing between successive stitches along the length of the bundle is in the range of 1 to 30 centimeters, preferably 1.8 to 8 centimeters.

BRIEF DESCRIPTION OF THE DRAWINGS

The invention will be more readily understood by reference to the drawings wherein.

DETAILED DESCRIPTION OF PREFERRED EMBODIMENTS

Figure 1:
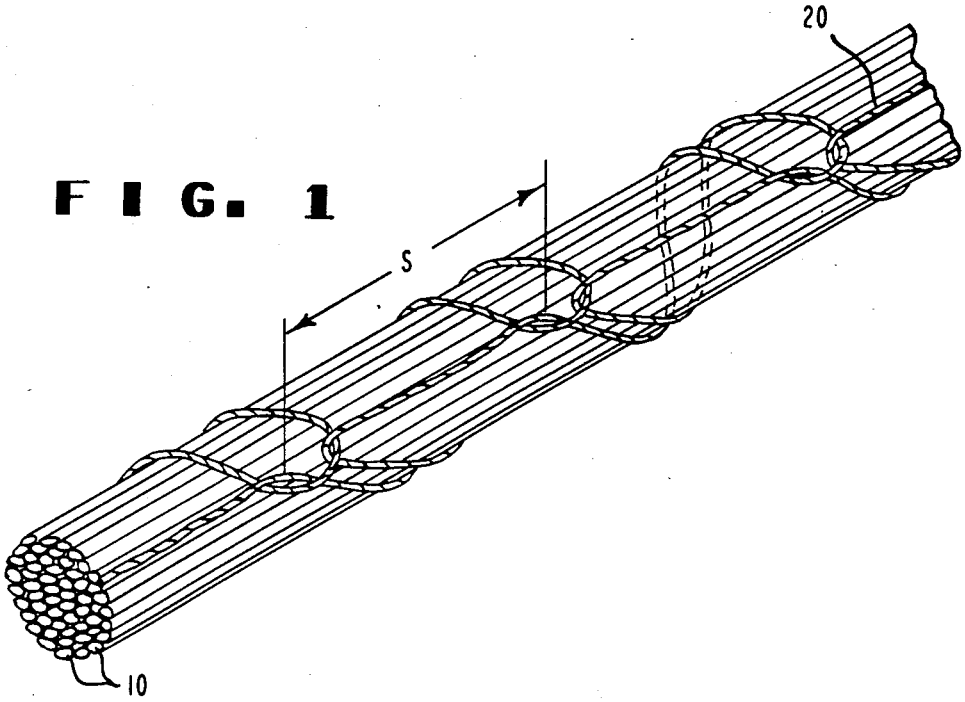
FIG. 1 depicts a length of the supply package of the invention.

As shown in FIG. 1, a plurality of substantially parallel elastomeric strands 10 are held together as a bundle by a single nonelastomeric thread 20 which forms a succession of connected chain stitches around the bundle. The succession of stitches extends along substantially the entire length of the bundle. For ease of visualization, the stitches are depicted looser than in actual practice.

The supply package of the invention can be handled without adjacent lengths of the bundle becoming entangled, as for example, when the supply package is shipped coiled up in a container. When it is necessary to release the individual elastomeric strands from the bundle for feeding to a textile machine, the succession of chain stitches is unravelled by pulling out the stitches in the reverse order of their fabrication.

The size and number of elastomeric strands 10 in the bundle can vary widely; for example, from less than 80 to over 4500 dtex and from fewer than six to over several hundred. The choice depends almost entirely on the requirements of the textile product being made.

There is also considerable latitude in the choice of nonelastomeric thread 20. Threads of natural or synthetic fibers, monofilaments, textured yarns, and the like are generally satisfactory. Usually, a low denier, inexpensive sewing thread is used, such as a 16-2 c.c. polyester or a 36-4 c.c. cotton thread ("c.c." means cotton count). A textured yarn is sometimes preferred for thread 20 when a tighter succession of chain stitches is required around the bundle.

The spacing between successive chain stitches, shown as "S" in the drawings, usually can be selected from a wide range of values. Stitch spacings of 30 cm or more, or of 1 cm or less can be used, as long as the elastomeric strands are held together well enough for handling in subsequent operations. However, average spacings of less than 1 cm usually are avoided in the interest of economy. Larger spacings employ less thread for the chain stitches and, at any given stitching speed, permit more meters of package length to be fabricated per unit time. The preferred range of average spacings is from 1.8 to 8 cm.

Figure 2:
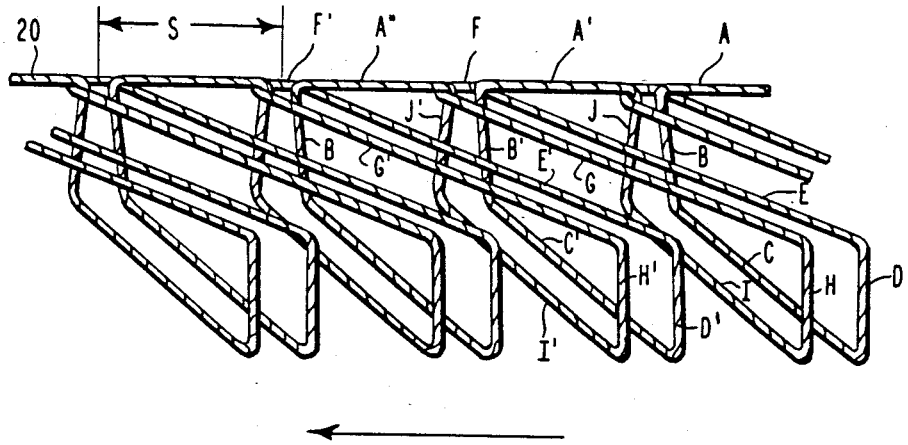
FIG. 2 is a schematic representation of a succession of chain stitches suitable for use in making the supply package.

FIG. 2 depicts a typical chain stitch which is suitable for use in the supply packages of the present invention. The stitches shown in FIG. 2 are of Stitch Type 501 (Federal Standard No. 751a, Jan. 25, 1965) and can be formed with a conventional chain-stitching, sewing machine with one needle thread. The formation of two successive stitches can be followed in FIG. 2, by progressing in the direction of stitch formation indicated by the arrow, from A through J for one stitch and then from A' through J' for the second stitch. As can be seen from the figure, the succession of stitches can be unravelled by pulling on the last-formed link in the chain, thereby reversing the chain-forming process. Other chain stitches than the one just discussed can be used in the present invention, such as those that require two threads to form the chain stitches. Also, two or more series of Type 501 chain stitches could be formed around a single bundle of strands. However, the simpler and more economical use of one single-thread series of chain stitches is preferred.

A conventional, industrial, chain-stitching sewing machine, such as an "over-edge" Merrow Model 70 Sewing Machine (made by the Merrow Machine Company of Hartford, Conn.), is suitable with minor modifications, for use in making the elastomeric strand supply package of the present invention. The machine ordinarily is designed to sew two pieces of fabric together or to sew closures for bags. Usually, the machine operates with relatively small stitch spacings (e.g., 2 cm or less) and at rates of about 1800 to 2250 stitches per minute. Thus, with a 2-cm stitch spacing, the machine can produce supply packages of the invention at rates of about 45 meters per minute. Increases in the speed of producing supply packages can be achieved by increasing the stitch spacing.

A convenient method for modifying an industrial sewing machine of the above-described type for use in preparing the supply packages involves the attachment of a "feed tube" and the substitution of puller rolls for the fabric feed mechanism of the machine. The feed tube can be a short tube through which the elastomeric strands are gathered together and fed through the sewing machine. The tube is placed between the upper and lower looper positions of the sewing machine such that the tube projects about 2½ cm. behind (i.e., downsteam of) the looper. The desired number of elastomeric strands can be fed from a conventional source (e.g., creels, warp beams), through a guide, and into the feed tube. As the elastomeric strands are pulled through the feed tube by the puller rolls, the machine sews a series of chain stitches around the outside of the tube. The puller rolls are located downstream of the outlet of the feed tube and are driven at a speed that is fixed with respect to the stitching speed to provide the desired stitch length. As the strands emerge from the tube, the chain stitches are pulled progressively along the axis of the tube until they slip off the outside of the tube onto and around the strands. The thusly formed bundle of strands, with the chain-stitched thread holding it together, then passes through the puller rolls and is collected in a container.

Instead of a feed tube, a groove can be ground between the lower and upper finger of the sewing machine to provide a passage for the elastomeric strands as the succession of chain stitches is sewn around them. Other methods of equivalently modifying or adapting chain-stitching sewing machines, or designing special machines, for the purposes of making the supply packages of this invention will readily be apparent to those skilled in the art.

Use of the package of the invention for feeding multiple elastomeric strands to a fabric-making machine is quite simple. The last-formed end of the package is removed from its container. The end of the chain-stitched thread is gently pulled to start the unravelling of the chain-stitches and to free the individual strands of the bundle from each other. The separated strands are then strung-up on the feed mechanisms of the fabric-making machine. The end of the chain-stitched thread is connected to an "unraveller", which can be in the form of a sucker gun or puller rollers which are fixed in speed with respect to the strand-feeding mechanisms of the fabric-making machine.

To demonstrate the present invention a yarn supply package was made and then used to knit a narrow elastic tape. Forty strands, each of 1120 denier Lycra® Type 121 spandex yarn (manufactured by E. I. du Pont de Nemours and Company) were unwound from a creel, combined into a bundle of substantially parallel strands and then wound with no twist onto an aluminum spool. The bundle of strands was then unwound from the spool and fed through a groove ground between the upper and lower "finger" of a Merrow Model 70 which had been fitted with a 1¼-cm wide finger and on which the feed mechanism was replaced by puller rolls. A 40-tex polyester sewing thread was stitched around the strands to provide an average chain-stitch spacing of two centimeters. The thusly formed supply package was collected in a plastic bag. The bag was then placed at the rear of a 14-gauge crochet knitting machine (Model PB-800, made by Comez SpA of Cilavegna, Italy). Six of the spandex strands from the supply package were strung up on the knitting machine, along with six ends of a 150-33 textured polyester yarn and then knit into a 0.95-cm-wide elastic tape. The chain-stitched polyester sewing thread of the supply package was readily unravelled and separated from the spandex strands by the application of a 55 to 85 gram pull along the axis of the package. In this demonstration, the thirty-four spandex strands that were not part of the knit tape, along with the unravelled sewing thread, were fed to waste containers. In this demonstration no difficulties were encountered in feeding the spandex strands from the supply packages to the knitting machine or in controlling the unravelling of the chain stitches from around the strand bundle.

An alternative to using a sewing machine for making the supply packages of the invention, is to use a needle or rapier loom. In using such looms, a multiplicity of parallel elastomeric strands would be formed into a bundle. The bundle would be fed as a unit to the loom where it would form one "warp yarn". The needle or rapier of the loom would carry a noneleastomeric thread or "weft". No binder thread would be used in con]unction with the weft. The bundle of elastomeric strands would be moved up and down in the conventional manner as a single warp thread and loops of the nonelastomeric weft thread would be formed over and under the bundle by the conventional movement of the needle or rapier. Successive loops of nonelastomeric thread would be connected by the latch needle of the loom to form a connected series of chain stitches around and along the length of the bundle. A loose weave, wherein successive loops are spaced about 2 or more centimeters apart, would be employed. In a similar manner, several elastomeric strand bundles (e.g., 2, 3, 4 or so) could be fed simultaneously to the loom. In such cases, supply packages would be woven wherein the loops of the succession of chain stitches penetrate the package in the manner of weft yarns. Such chain stitches however, would still be unravellable in the same manner as those formed with the sewing machine or those formed with the loom when only one bundle of elastomeric strands is fed.

We claim:

1. A process for making an elastomeric yarn supply package wherein a succession of connected chain stitches is sewn with a nonelastomeric thread around and along the length of a generally cylindrical bundle of substantially parallel elastomeric strands, the stitches encircling without penetrating the bundle and having a spacing in the range of 1 to 30 cm.

2. The process of claim 1 wherein the chain stitches are formed by a single nonelastomeric thread.

3. A process of claim 1 or 2 wherein a bundle of substantially parallel elastomeric strands is passed into a feed tube located between an upper and lower looper position of an over-edge chain-stitching sewing machine and projecting downstream of said looper positions, forming a connected succession of chain stitches around the outside surface of the feed tube, forwarding the strand bundle through the tube while simultaneously pulling the chain stitches in the same direction so that the stitches slip off the tube and onto and around the strand bundle.

4. In a process of feeding a plurality of elastomeric strands to a textile machine, the improvement comprising supplying the strands from a package which comprises a bundle cylindrical of substantially parallel elastomeric strands held together by a nonelastic thread which forms a succession of connected chain stitches along the length of the bundle, each stitch encircling without penetrating the bundle, and unravelling the chain stitches from the bundle to free the elastomeric strands from each other while feeding the freed portions of the strands to the textile machine.

* * * * *